United States Patent [19]

Schuurink

[11] 3,978,592

[45] Sept. 7, 1976

[54] DRYER IN PARTICULAR FOR LAUNDRY

[76] Inventor: Fredrik A. Schuurink, 27, Fr. Rooseveltlaan, Breda, Netherlands

[22] Filed: Aug. 28, 1974

[21] Appl. No.: 501,233

[30] Foreign Application Priority Data

Sept. 3, 1973 Netherlands ..... 7312132

[52] U.S. Cl. ..... 34/82; 34/133; 55/490

[51] Int. Cl.[2] ..... F26B 21/06

[58] Field of Search ..... 34/82, 133; 55/490, 55/495, 500, 507, 509, 511, 529

[56] References Cited

UNITED STATES PATENTS

| | | | |
|---|---|---|---|
| 2,546,925 | 3/1951 | Geldhof et al. | 34/82 |
| 2,675,628 | 4/1954 | O'Neil | 34/82 |
| 2,751,688 | 6/1956 | Douglas | 34/82 |
| 2,862,306 | 12/1958 | Morrill | 34/82 |
| 3,378,934 | 4/1968 | Erickson | 34/82 |
| 3,483,632 | 12/1969 | Triplett | 34/133 |
| 3,570,138 | 3/1971 | Douglas et al. | 34/133 |

*Primary Examiner*—Kenneth W. Sprague
*Assistant Examiner*—James C. Yeung
*Attorney, Agent, or Firm*—Stevens, Davis, Miller & Mosher

[57] ABSTRACT

A laundry dryer having a lint screen which lies diagonally across an air passage defined between the door and body of the dryer so as to be readily accessible for cleaning when the door is opened. A perforated plate is positioned between the lint screen and the dryer drum to protect the screen from damage by articles in the drum.

4 Claims, 2 Drawing Figures

DRYER IN PARTICULAR FOR LAUNDRY

This invention relates to a dryer, in particular for laundry, provided with a screen.

In the known dryers, the screen is frequently provided at a spot that is not immediately accessible, which means that the screen cannot be cleaned without preliminary actions. This has several objections.

In the first place it is then difficult to remove the substances such as lint are deposited on the screen, thus it often happens that the screen is not cleaned at all or only rarely, which may lead to inferior drying performance, as the resistance across the screen increases.

Because of this, it is necessary to operate the dryer longer for a good drying performance, in which the drying time required can exceed by a number of times the drying time necessary when one has a clean screen.

Moreover, due to screen blockage it may occur that the dryer does not work at all.

The aim of the invention is to eliminate said objections, with the screen mounted in the door, in such a way that when the door is in the opened position the screen surface is immediately accessible.

Because of this it is not only possible to clean the screen easily but in practice this practically cannot be forgotten, as one is forced to do this as otherwise the dirt could come into the space surrounding the dryer when loading the dryer with laundry. More importantly, when taking the clean, dry things out of the dryer, this laundry would very likely come into contact with the dirty screen surface if the surface is not first cleaned.

In the apparatus according the invention, cleaning can be performed even by wiping with a finger across the screen surface.

If the dryer is constructed such that at least a portion of the air is recirculated and the exhaust of the air takes place through apertures in the door, the preferred embodiment is such that the exhaust openings of the drum are provided in a plate with a bent edge or with legs directed to the outside plate of the door. The inner edge of the screen are attached to this edge or these legs, while the outer edge of the screen is attached to a plate of the door located at a distance from the outside plate of the door. All this is done in such a way that the distance from the screen to the plate to which the screen is attached decreases from the inner edge to the outer edge of the screen, leading to a simple construction.

In order to simplify the assembly, the construction, according to a further characteristic of the invention, is such that by tightening a bolt or the like, located in the center of the plate which provides exhaust openings from the drum, the screen which is pre-attached to the inner edge and the outer edge is brought in position.

The invention will now be described in detail with reference to the accompanying drawings in which.

Figure 1:
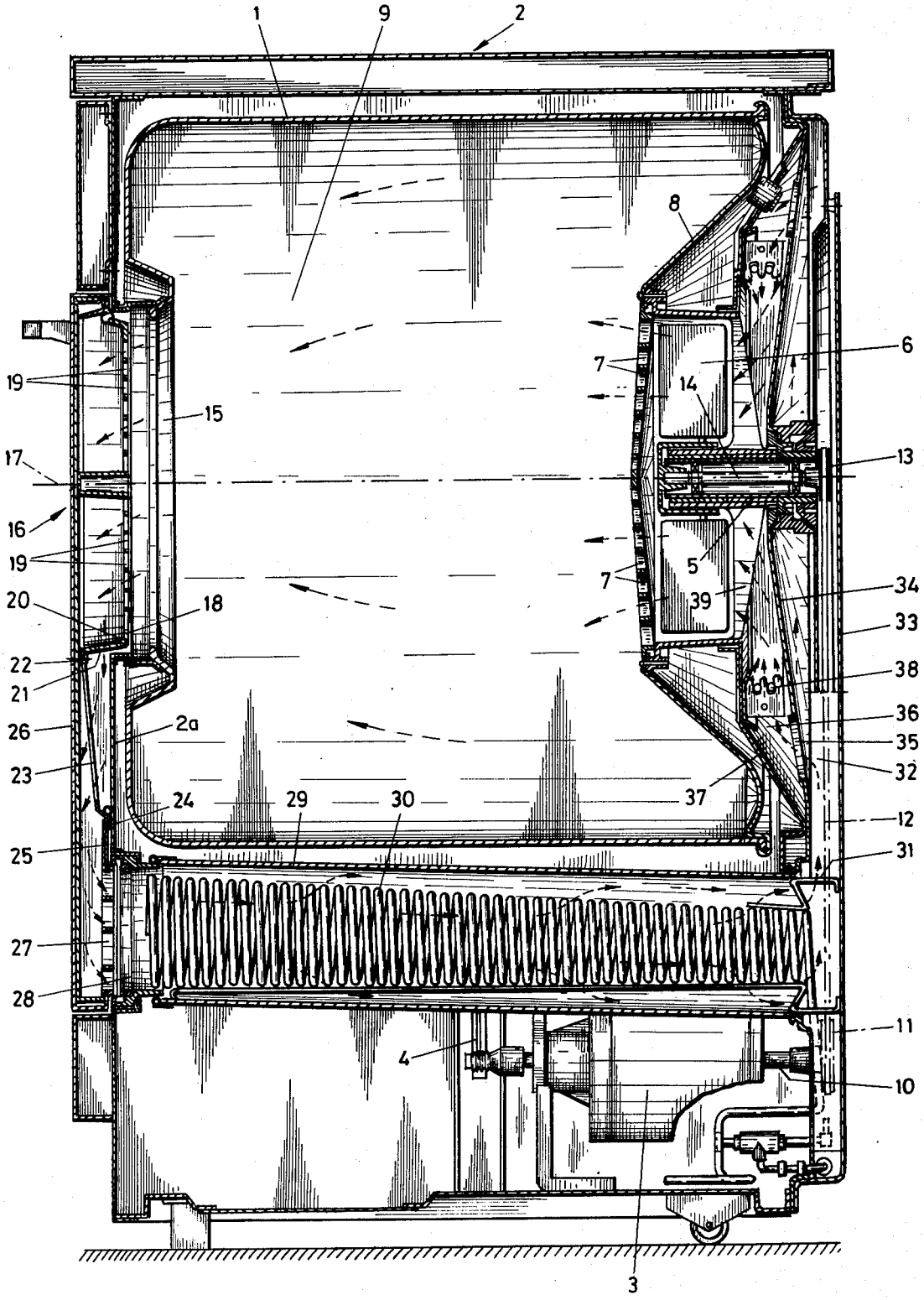
FIG. 1 shows a vertical section of the dryer, the upper part of which is taken according to the plane of symmetry of the dryer and the lower part through one of the two symmetrically arranged condensers.

The dryer contains a drum 1, which can rotate in a housing 2, whereby the driving of the drum 1 from a motor 3 via a belt 4, by means known but not shown, takes place around a bearing 5 mounted in the housing 2. A fan 6, which blows air via apertures 7 in the middle of the frusto-conical back wall 8 of the drum 1 into the drying space 9, is driven by the motor 3 via a shaft 10, pulley 11, belt 12, pulley 13 and shaft 14.

At the front side of the drum 1 is a filling hole 15 for the laundry, which is closed by a door 16 during drying. The door 16, which is hinged, by means not shown, to for example a horizontal hinge at the bottom of the door 16 connected to the housing 2, has a plate 18 symmetric around the center line 17 of the drum 1, with vent holes 19 for the drying air that has passed through the drum and that has absorbed the moisture of the laundry. The plate 18 is provided with a circular edge 20 having apertures 21 or provided with legs 20 with apertures 21 in between. At the edge or the legs 20, the inner edge 22 of a screen 23, made of synthetic material, for instance a polyether, is connected, the lower edge 24 of which is attached to a plate 25 of the door 16.

At the front side, the door 16 is provided with an end plate 26, located at a small distance from the plate 25. The inner edge 22 of the screen 23 is located closer to the end plate 26 than the lower edge 24, because of which the distance of the screen 23 to the plate 25 from the inner edge 22 to the outer edge 24 decreases. As shown in FIG. 1, when the door is closed the plate 26 and a plate **2*a* of the housing 2 define an air passage therebetween in which the screen 23** is positioned.

In the plate 25 two round apertures 27 have been provided at a distance from and at both sides of the vertical plane through the center line 17, each of which, with the door 16 in a closed position, lies opposite to apertures 28 in the housing 2.

On these apertures 28, tubes 29 are connected, in which condenser tubes 30 are located, for instance consisting of tubes through which a cooling agent, for instance water, flows.

The back side of the tubes 29 is connected via apertures 31 to a space 32 formed by the back plate 33 and a conically shaped plate 34 of the housing 2. In the plate 34 apertures 35 have been provided, which connect the space 32 with a space 36 formed between the plate 34 and a wall 37 of the housing, in which space 36 a heating device 38, for instance an electric heating, is located.

The space 36 is connected, via an annular aperture 39 located around the bearing 5, with the space in which the fan 6 is located.

The operation of the apparatus is as follows:

Dry and heated air is blown by the fan 6 via the apertures 7 into the drying space 9 of the drum, after which the air, after having absorbed the moisture from the laundry, the through he screen 23, via the apertures 19 in the plate 18, the apertures 21 in the edge 20 of this plate 18. The screen 23 arrests dirt, filaments, etc.

From the screen 23 the humid air comes via the apertures 27 and 28 in the tube 29, during which the condenser 30 condenses the water vapor present in the air. The now dry air, which means air from which by means of condensation a large portion of the moisture has been extracted, passes via apertures 31 to the space 32 and therefrom via apertures 31 to the space 32 and therefrom via apertures 35 to the space 36, in which the air is heated by the heating device 38.

The now dry and heated air is drawn in by a fan 6 via aperture 39 and subsequently blown into the drying space 9. The air flow is indicated with arrows.

Figure 2:
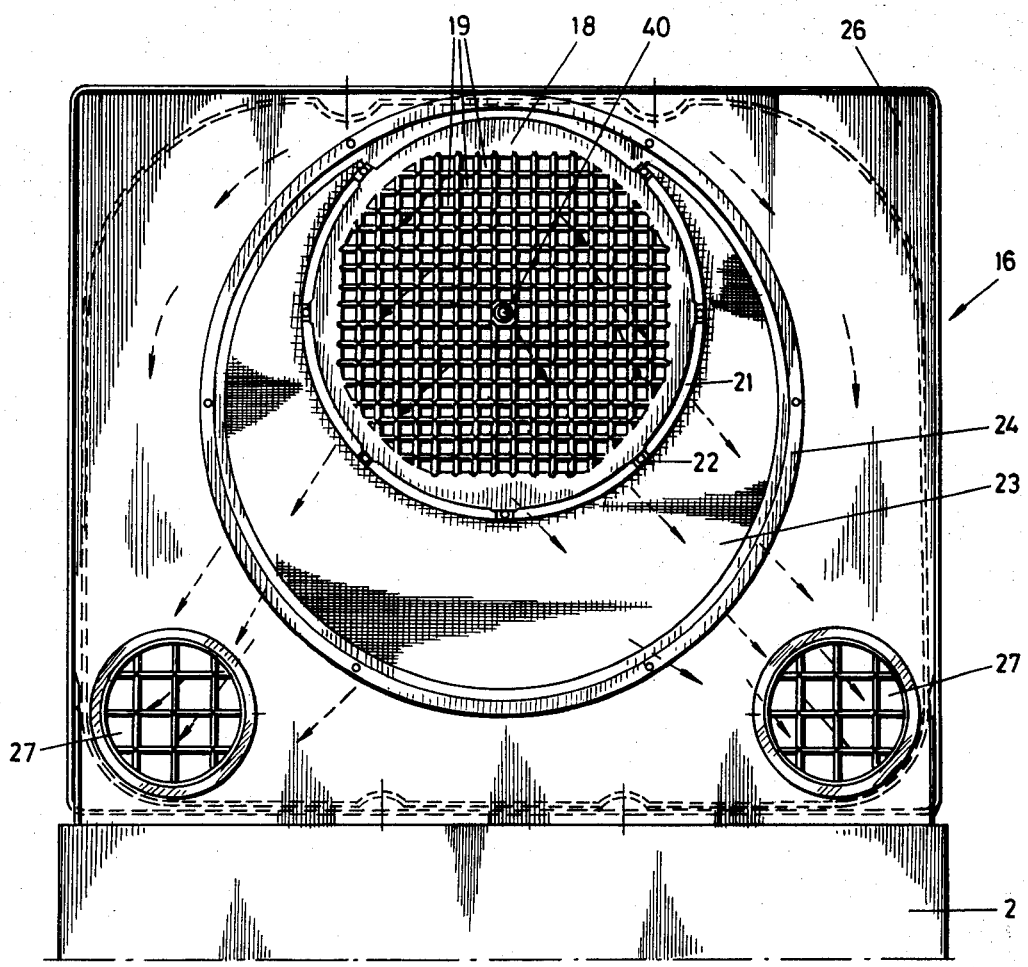
FIG. 2 shows a top view of the door in opened position.

FIG. 2 shows a top view of the door 16 in opened position.

The horse-shoe-shaped screen 23, pre-attached to the inner side of the edge 20 of the plate 18 and to the outside of the plate 15, is, by tightening of the bolt 40 or the like, secured to the end plate 26, by which the screen 23 is tensioned at the same time.

The screen 23 is immediately accessible in the opened position of the door 16 and can therefore be cleaned easily.

It is observed that the invention is not limited to the embodiment described.

Thus the apparatus is not limited to a dryer with condensation or the condensing device shown and can for instance also be applied to equipment with partial circulation with or without condensation or to equipment without circulation.

It is further possible to use one or more than two condensers instead of two condensers.

What we claim is:

1. A dryer such as for laundry in which at least a portion of the air is recirculated, said dryer comprising:

a housing;

a rotatable drum in said housing, one end wall of said drum having an opening defined therein for access thereto and discharge of air therefrom;

said housing comprising an end plate having an opening therein of a size and location corresponding substantially to that of the drum opening and a plate portion which extends in a first direction from the periphery of the housing opening;

an openable and closable door mounted on said housing, said door comprising:

an outer plate spaced outwardly in a second direction perpendicular to said plate portion from said plate portion to define an air passage therebetween when the door is closed, a perforated plate having at least a portion spaced inwardly in a direction opposite to said second direction from said outer plate a distance at least as great as the distance between the outer plate and the plate portion when the door is closed, said portion of said perforated plate being coextensive with the drum opening and lying substantially in the plane thereof when the door is closed.

an inner plate having means defining an opening therein of a cross-section greater than that of the drum opening, at least a portion of the periphery of the opening in the inner plate being spaced in said first direction from the periphery of the portion of the perforated plate to define a space therebetween, said inner plate having a portion substantially coplanar with said plate portion when the door is closed, said portion of said inner plate extending substantially in said first direction from the portion of the periphery of the opening in the inner plate and defining with said outer plate a continuation of said air passage when the door is closed, and a lint screen, one edge of which is connected to the inner plate adjacent the portion of the periphery of the opening therein, said lint screen extending from that connection toward the perforated plate and the outer plate whereby when the door is closed said lint screen extends across the air passage to trap lint moving with the air through the perforated plate, the air passage and said continuation thereof and when the door is open said lint screen can be easily cleaned since it lies in the then open space between the portion of the periphery of the opening in the inner plate and the perforated plate.

2. The dryer of claim 1 in which a first edge of the screen is secured to the door adjacent the edge of the perforated plate and said one edge of the screen is secured to the inner plate downstream from the first screen edge so that the screen runs at an angle across the air passage.

3. The dryer of claim 2 in which the screen is substantially horseshoe shaped.

4. The dryer of claim 1 in which a first edge of the screen is secured to a bent over edge of the perforated plate.

* * * * *